United States Patent [19]

Eheim

[11] 4,171,689

[45] Oct. 23, 1979

[54] DEVICE FOR THE CONTROL OF GAS ADMISSIONS INTO THE INDUCTION MANIFOLD OF AN INTERNAL COMBUSTION ENGINE

[75] Inventor: Franz Eheim, Stuttgart, Fed. Rep. of Germany

[73] Assignee: Robert Bosch GmbH, Stuttgart, Fed. Rep. of Germany

[21] Appl. No.: 868,944

[22] Filed: Jan. 12, 1978

[30] Foreign Application Priority Data

Jan. 29, 1977 [DE] Fed. Rep. of Germany ..... 2703687

[51] Int. Cl.[2] ..... F02M 25/00; F02M 21/02; F02M 23/04

[52] U.S. Cl. ..... 123/119 A; 123/119 DB; 123/120; 123/121; 123/124 R; 123/198 A; 261/42; 261/44 R; 261/64 R

[58] Field of Search ..... 123/119 A, 124 R, 119 D, 123/119 DB, 120, 121, 198 A; 261/42, 43, 44 R, 64 R

[56] References Cited

U.S. PATENT DOCUMENTS

| | | | |
|---|---|---|---|
| 1,679,521 | 8/1978 | Good | 123/119 A |
| 3,643,640 | 2/1972 | Krauss | 123/119 A |
| 3,662,722 | 5/1972 | Sarto | 123/119 A |
| 3,741,179 | 6/1973 | Vartaman | 123/119 A |
| 4,085,718 | 4/1978 | Schaal | 123/119 A |
| 4,094,285 | 6/1978 | Oyama et al. | 123/119 A |

FOREIGN PATENT DOCUMENTS

| | | | |
|---|---|---|---|
| 990597 | 6/1976 | Canada | 123/119 A |
| 2232705 | 1/1974 | Fed. Rep. of Germany | 123/119 A |
| 2303007 | 7/1974 | Fed. Rep. of Germany | 123/119 A |
| 2543804 | 4/1977 | Fed. Rep. of Germany | 123/119 A |
| 1388032 | 3/1975 | United Kingdom | 123/119 A |

*Primary Examiner*—Wendell E. Burns
*Attorney, Agent, or Firm*—Edwin E. Greigg

[57] ABSTRACT

A device for controlling the admission of additional gas, such as exhaust gas, to the induction tube of the engine so that additional gas quantities are admitted to the induction tube only during partial load operation. The device includes an additional gas quantity valve situated within the induction tube. The valve includes, in its various embodiments, structure to assure a high tolerance factor in the engagement of the valve seat and the movable valve member so that wear and temperature effects will not adversely affect the control of the additional gas quantity flow.

22 Claims, 6 Drawing Figures

DEVICE FOR THE CONTROL OF GAS ADMISSIONS INTO THE INDUCTION MANIFOLD OF AN INTERNAL COMBUSTION ENGINE

BACKGROUND OF THE INVENTION

The invention relates to a device for the control of additional quantities of gases into the induction manifold or tube of an internal combustion engine downstream of a throttle valve, the construction being such that the throttle valve is arranged to control entry of gases into the air stream. In this type of known device an exhaust gas return line opens vertically into an induction tube of an internal combustion engine so that the opening plane in the center of the induction tube lies approximately at the height of a throttle valve shaft. The opening of the exhaust gas return line is associated with the throttle valve in such a manner that the portion of the throttle valve that lies downstream of the throttle valve shaft completely closes the opening of the exhaust gas return line when the throttle valve is completely opened. In order to maintain a sealed closing of the exhaust gas return line, however, there needs to be a precise association of the throttle valve and the opening plane of the exhaust gas return line.

OBJECT AND SUMMARY OF THE INVENTION

The regulating device according to the present invention in contrast has the advantage that misalignments that occur from expansion and contraction of the cooperative elements, as well as wear that occurs from intermittent contact with one another, are compensated for by the movability of the seating surfaces, that is of the closing element, and the tight sealed abutment of the closing element against the valve seat is consequently achieved. In this manner, when the throttle valve is completely opened the exhaust gas return line is perfectly sealed and thereby prevents entry of any exhaust gas into the manifold when the throttle valve is in the full-load range. Accordingly, a distinguishing characteristic of this invention resides in the fact that the exhaust gas return line which enters the intake manifold and the zone of the throttle valve that contacts the terminus of said exhaust gas return line are shiftable relative to one another to compensate for inaccuracies in assembly.

Another advantage of this invention is to provide the terminus of the exhaust gas return line with a spring loaded cap member which can be urged axially of the exhaust gas return line during full-load operation of an internal combustion engine.

According to one feature of this invention, a flexible bellows member is provided in the gas return line which can compensate for pressure of the throttle valve under full-load operation of the engine and properly seal the abutting surfaces.

According to another feature of the invention, a modified throttle valve with a tiltable member is provided which can be brought into abutment with the terminus of the exhaust gas return line to assure precise sealing between the respective elements.

According to yet another feature of the invention the throttle valve or an adjunct associated therewith is provided with a sealing material that is capable of withstanding excessive temperatures.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
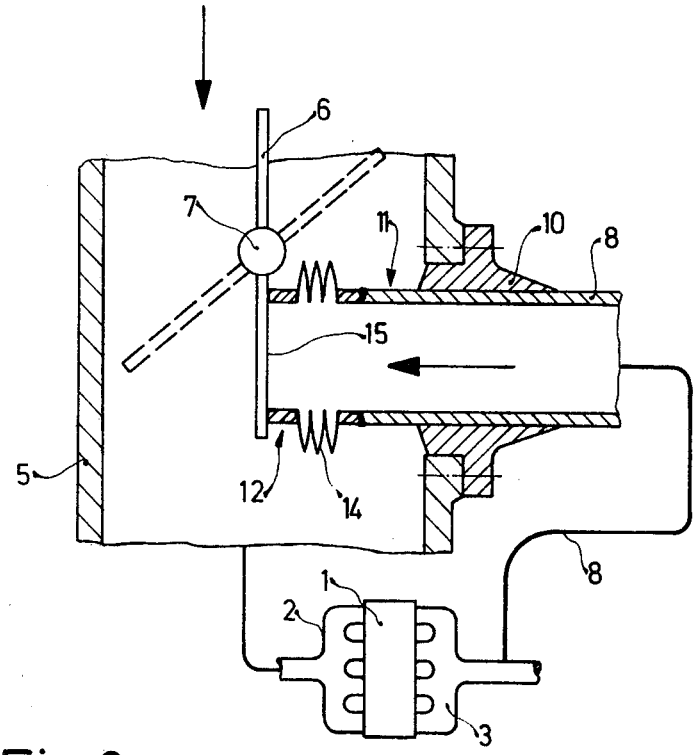
FIG. 1 is a fragmentary cross-sectional view of the first embodiment of the invention in which is shown intake and exhaust gas lines extending from an internal combustion engine and wherein the terminal portion of the gas line includes a flexible bellows member.

Turning now to FIG. 1, there is shown a simplified internal combustion engine 1 with an induction system 2 and an exhaust gas collection system 3. An enlarged portion of the induction tube 5 by means of which the internal combustion engine is supplied with fresh air is shown and in which a main throttle valve is rotatably arranged on a throttle valve shaft 7 and thereby adapted to control the mixture flow rate in a known manner. Downstream of the main throttle valve shaft 7 an exhaust gas return line 8 opens into the induction tube 5 with this exhaust gas return line 8 arranged to branch off from the exhaust gas collection system 3. In this exemplary embodiment the exhaust gas return line is mounted within a flange 10 that is positioned in the induction tube perpendicularly to the axis of the induction tube 5. The exhaust gas return line that projects into the induction tube has a terminal portion 11 to which is attached a bellows-like structure 14 to the free end of which is also attached a relatively short section of pipe that is adapted to form a seat for the throttle valve 6, as shown. It is to be understood that the bellows in order to have a certain amount of flexibility is appropriately welded or soldered to the terminus of the exhaust gas line 11.

The short section of pipe 12 terminates in the center of the induction tube and thus forms a valve seat for that portion of the throttle valve that lies downstream of the throttle valve shaft 7 and in this case is formed as a valve closing member and arranged to close the opening 15 of the short section of pipe 12 when the throttle valve is completely opened. This embodiment of the invention is typical of the various disclosures herein that are adapted for the control of the exhaust gas return quantities in this internal combustion engine. Under full-load when the maximum performance is demanded of the internal combustion engine the exhaust gas return line is completely closed off. In the partial-load range, on the contrary, when the throttle valve is only partially opened, a varying quantity of exhaust gas is thereby added to the fresh air.

In order to achieve a secure closing of the exhaust gas return line when the throttle valve is fully opened, the opening plane of the return line must be perfectly aligned with the plane of the fully opened throttle valve. Accordingly, by means of the first embodiment of this invention, the short section of pipe 12 is axially shiftable in the direction of the exhaust gas return line 8 and also slightly rotatable so that the short section of pipe can self-adjust to the precise plane of the throttle valve and the opening indicated by a numeral 15 in the end of such short section of pipe is tightly closed. By means of the flexible bellows 14 the exhaust gas return line 8 can also be arranged in the induction tube so that the short section of pipe 12 is shifted in every instance by a certain amount when the throttle valve is fully opened. In this manner, additional closing forces can be produced which press the short section of pipe 12 against the lower half of the throttle valve that serves as the closing member. As a further improvement on this structure revealed in FIG. 1, it is also contemplated that the lower portion of the throttle valve or the seating surface of the short section of pipe 12 can be coated with a sealing material of high temperature durability.

By means of these measures the demands on the precise placement of the exhaust gas return line in the induction tube 8 are substantially less. Misalignments in the positioning of the exhaust gas return line in the induction tube are compensated for by the yielding of the short section of pipe 12 that is flexibly mounted to the end of the bellows element 14. Should, however, a sealing layer be provided which has a sufficient degree of elasticity and yieldability, then the bellows is no longer necessary.

Figure 2:
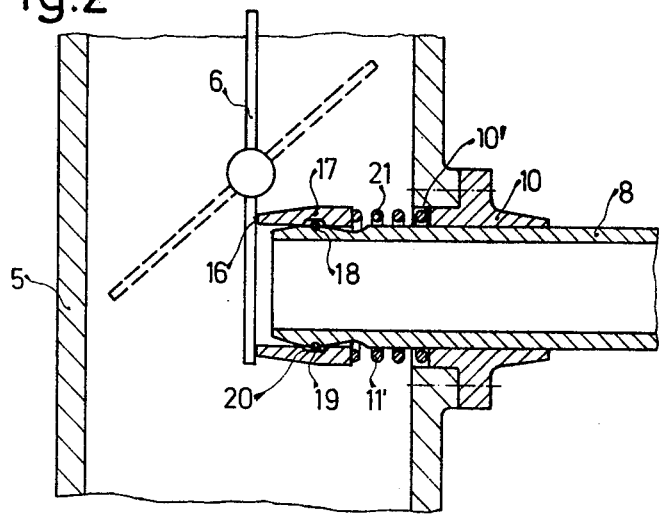
FIG. 2 is a fragmentary cross-sectional view of a second embodiment of the invention wherein a spring-loaded cap member is tiltably supported on the terminus of the exhaust gas line.

FIG. 2 shows the same portion of the induction tube 5 as that shown in FIG. 1. Also in this embodiment, an exhaust gas return line 8 is connected with the induction tube 5 by means of a flange 10. The rigid portion 11' of the exhaust gas return line that projects into the induction tube includes an end area that is produced as a partial sphere and carries a movable ring or cap 17 as the actual opening element and further includes an end portion 16 that functions as the valve seat for the throttle valve. An annular groove 18 is provided in the cap-like spherical member 17 adjacent to the extremity of the exhaust gas return line 11 in which groove 18 is positioned a spring ring 19. As shown in the drawing, the spring ring 19 projects into a guide groove 20 that is milled in the inner face of the ring 17, said groove having a longitudinal extent in the direction of the exhaust gas return line that limits the maximum path through which the cap can be shifted. The flange 10 which supports the gas return line 11 in the induction tube 5 has an end face 10' against which one end of a spring is arranged to abut with the other end of said spring adapted to urge the cap member 17 in an outward direction. It is also clear from the drawings that the frontal surface 16 of the cap member 17 serves as a valve seat for the lower half of the throttle valve that functions as a valve closing member.

When the throttle valve is fully opened, the cap member 17 is pushed in an axial direction against the face of the spring 21 so that it is sealably seated about the time the end position of the throttle valve is reached. This is clearly shown in the view in FIG. 2 where the throttle valve is shown in full lines seated against the cap member 17. Thus, on the one hand, a sealing force is produced and, on the other hand, possible misalignments of the cap member 17 with the throttle valve are compensated for. Any misalignment in the insertion of the exhaust gas return line 8 into the induction tube 5 can be compensated for since cap member 17 is rotatably supported on the spring ring 19 as will be understood from the earlier description hereof.

This embodiment has the advantage that when there is a tight fitting provided between the cap member 17 and the line 11' a proper and sufficient level in sealing is achieved. Thus this arrangement is less expensive when compared to the device disclosed in FIG. 1. The pressure spring 21 used in the concept revealed in FIG. 2 assures a higher durability of the return force than would be the case in the embodiment shown in FIG. 1 where the collapsible bellows is utilized.

Figure 3:
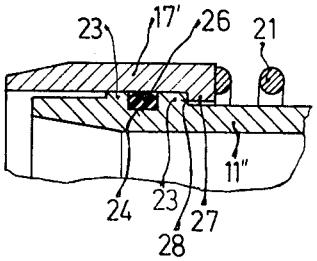
FIG. 3 is a fragmentary cross-sectional view of a further embodiment of the seal member shown in FIG. 2.

In FIG. 3 there is shown a variation of the embodiment of the invention discussed immediately above. FIG. 3 is an enlarged partial view of the cap member which cooperates with the throttle valve. In this view the exhaust gas return line 11' is provided with a pair of annular rings 23—23 between which is provided an annular groove 24 and within which an elastic heat-durable seal is seated. The cap 17' is freely slidable on the annular rings 23—23 and includes at its rearmost surface an inner flange 27 that is adapted to be seated against the aft ring 23 by spring 21, as shown.

In this embodiment, the cap 17' can be shifted and also slightly rotated by the throttle valve, so that here, too, possible inaccuracies in the positioning of the exhaust gas return line in the axis of the induction tube can be compensated for. In contrast to the embodiment of the invention disclosed in FIG. 2, this concept is simpler to produce. Still, with the aid of the elastic seal 26 a good sealing operation can be achieved.

Figure 4:
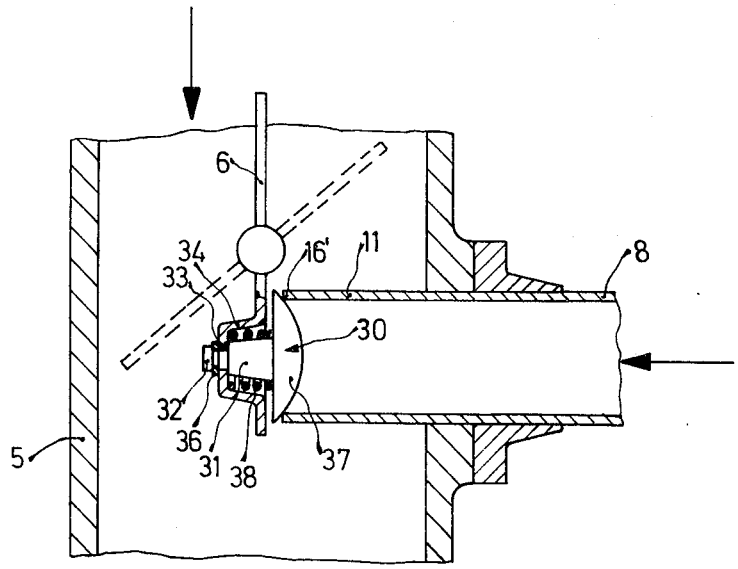
FIG. 4 is a fragmentary cross-sectional view of another embodiment of the invention showing a throttle valve adapted to support a tiltable closure member.

FIG. 4 shows still another embodiment of this invention in which the terminus of the exhaust gas return line 8 is provided with a frontal surface 16' which serves as a valve seat. Furthermore, in this concept, a valve closing member 30 is provided with a rounded head 37 which extends into the opening 11 and seats against the frontal surface 16'. The rounded head 37 is integral with a frustoconical shaft 38 which terminates in a pin 32 which pin extends through a bore 33 in a perforated cup-shaped member 34 that is formed in any suitable manner in the lower portion of the throttle valve 6. As clearly shown in FIG. 4, a ring 36 is interposed between the outer wall of the cup-shaped member 34 and the pin 32 and by means of which a definite axial movability of the valve closing member 30 is assured. The difference between the diameter of the pin 32 and the bore 33 through which it extends provides for limited oscillatory movement of the rounded head 37 so that it can be easily accommodated to the surface 16' of the gas return line 8. A spring 38 is interposed between the rear face of the closing member 30 and the inner wall of the cup-shaped member, as shown, and thus in this way the valve closing member is maintained in its original position against the stop defined by the securing ring 36.

Accordingly, when the throttle valve is moved into its full-load position, as shown in the drawing, the rounded head 37 is seated against the frontal surface 16' thereby sealing the exhaust gas line 11. It will be readily understood that in this concept the valve closing member 30 is easily shiftable as well as readily rotatable about its support relative to the cup-shaped member.

As explained earlier herein, the rounded head 37 of the valve closing member can be coated with sealing material. In addition, to improve the seal between the respective surfaces, the terminus 16' can be complementally chamfered to receive the curved area of the closing member 30.

Figure 5:
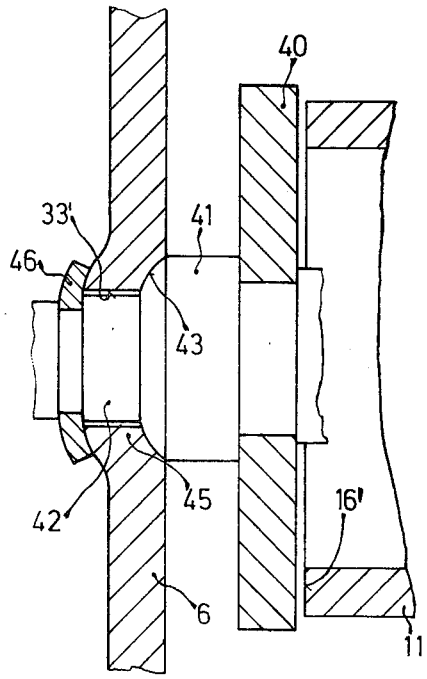
FIG. 5 is a further fragmentary cross-sectional view of another type of throttle valve adapted to support a pivotal closure member.

The embodiment of the invention shown in FIG. 5 illustrates an enlarged cross-sectional fragmentary view of the invention and in this instance only a limited portion of the rigid gas return line that projects into the induction tube is shown.

The frontal surface 16 serves also in this embodiment as the valve seat. A perforated disc 40 is used as a valve closing member and the perforated area is provided with a pin 41 that is adapted to project through a perforation 33' in the throttle valve 6. The pin 42 formed integrally with the pin 41 has a smaller diameter and is formed in the transitional area near the collar 43 with a conical surface which progresses from a larger diameter shown at 41 to the smaller diameter shown at 42. As clearly shown in FIG. 5, the throttle valve 6 has a complementally formed depression that is adapted to receive the conical surface 43 of the pin 41 and on the outer side of the throttle valve 6 is positioned a perforated disc 36 that is also complemental to the opposite face of the throttle valve. As a consequence, the difference between the diameter of the pin 42 that extends through the throttle valve 6 and that of the bore 33' allows a wobbling movement of the pin 41 and thereby of the valve closing member 40. The disc 46 is so arranged that during this wobbling movement there are no frictional forces of consequence, but on the other hand there is also no considerable axial play. This can be achieved especially well since the disc 46 is formed as a spring ring. With this embodiment, too, as explained earlier in connection with the other embodiments, during the opening movement of the throttle valve, that is with the movement of the valve closing member into abutment with the face 16 of the gas return line, the disc 40 is adapted to adjust itself properly to the terminal portion 16.

This embodiment of the invention has a further advantage that in every instance it will adapt itself to sealing abutment of the valve closing member 40 against the valve seat 16. It is of no consequence whether the opening of the exhaust gas return line 8 is deformed into the shape of an oval, for example, because of high temperatures in the induction tube 5. The only matter of importance is that the valve seat, that is, the frontal surface 16 is ground to a finished plane prior to assembly in the induction tube. The valve closing member 40 also can be easily produced with the necessary precise fitting. The adjusting device of this concept is also not directly subjected to fouling by exhaust gases as may be experienced with some of the earlier embodiments of the invention disclosed herein. In other words, the adjusting device is non-sensitive to fouling and is easy to produce.

The embodiment of the invention disclosed in FIG. 6 operates according to the general principle shown and described in connection with the embodiment of the invention of FIG. 5. In this instance, the valve seat is formed by the frontal surface 16 of the terminus 11 of the exhaust gas return line 8. The frontal surface 16 is also associated with a valve closing member in the shape of a perforated disc 48 which is riveted to a pin 49. The pin 49 terminates in a rounded head, as shown, the diameter of which is larger than that of the pin 49. The head 50 is complemental to and seated in a ball socket suitably drawn as at 51 in the throttle valve 6 and secured axially therein by a snap ring 53, which is arranged in an annular groove 54 provided in a cylindrical portion 55 between the ball socket 51 and the plane of the throttle valve 6. Here it is believed to be clear from examination of FIG. 6 that the arrangement of the snap ring 53 will provide for a slight wobbling movement of the disc 48 which will allow for suitable sealing of the disc against the frontal edge 16 of the terminus 11. The arrangement shown in FIG. 6 has the same advantages that were described in connection with FIG. 5. Because, however, in this structure after each lifting of the disc 48 away from the valve seat, the disc can tilt relative to its support and thereby perform a rotating motion, one or two additional integral curved leg means 57 are provided on the disc 48, as shown, which are adapted to engage in suitable apertures 58 in the throttle valve. With such an arrangement, the valve closing member 48 can be prevented from rotating. This concept is particularly important, for where oval deformation of the opening of the exhaust gas return line is experienced it is assured that the valve closing member 48 always comes to rest in the same position on the valve seat 16. If carbon deposits should form on the disc 48, then it is assured by use of this structure that the respective confronting surfaces which are kept free of exhaust gas deposits will always come into contact with each other when the throttle valve is moved into a fully opened position. The embodiment of the invention according to FIG. 6 is further distinguished by the special movability and adaptability of the valve closing member with an even more precise association of the corresponding sealing surfaces with each other.

As a substitute for the ball and socket-like portion 51 this portion can also be used as a preformed cup in the throttle valve during the drawing process. Any other technically equivalent structure which would secure against rotation of the disc 48 can also be used.

By means of this invention, and especially the exemplary embodiments described herein, the tightness of the seal of the exhaust gas return line in the full-load position of the throttle valve is substantially increased. In this manner, the emissions values and the consumption of the Diesel engine that operates with an exhaust gas return line is substantially improved because during full-load operation of the maximum rate of fresh air that can be introduced, that is the degree of admission, is not influenced by additional amounts of exhaust gas.

Figure 6:
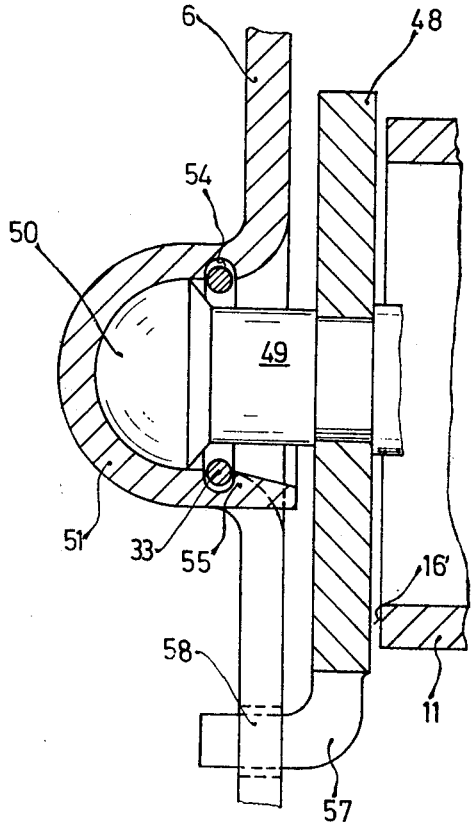
FIG. 6 is still another fragmentary cross-sectional view of another embodiment of a throttle valve and closure member.

In addition, the embodiments of the invention according to FIGS. 5 and 6 offer also the advantage that the cross section of the exhaust gas return line can have any shape desired, such as oval or rectangular. In this manner, the distance of the axis between the throttle valve shaft and the opening of the exhaust gas return line can be decreased. The result is that with equal opening cross sections, lower return adjusting torques result from the exhaust gas pressure on the adjusting device.

The foregoing relates to preferred exemplary embodiments of the invention, it being understood that other embodiments and variants thereof are possible within the spirit and scope of the invention, the latter being defined by the appended claims.

What is claimed is:

1. In an air induction tube of an internal combustion engine within which a throttle flap valve is pivotably mounted with a portion thereof being pivoted in the direction of air flow through the induction tube, a device for controlling the admission of additional gas quantities into the induction tube, comprising:

an additional gas supply line;

means mounting the additional gas supply line to the induction tube with part of the additional gas supply line extending into the induction tube;

an opening element arranged within the induction tube as an extention of the additional gas supply line and defining therein a free end;

resilient means connected to the additional gas supply line and the opening element for biasing part of the opening element past the additional gas supply line into the induction tube where said free end defines a valve seat; and a movable valve member for engagement with the valve seat for controlling the flow of additional gas quantities from the additional gas supply line past the valve seat and into the induction tube, said movable valve member consisting of that portion of the throttle flap valve which is pivoted in the direction of air flow, wherein said opening element is both axially and rotationally shiftable relative to the additional gas supply line due to engagement with the movable valve member under the influence of said resilient means.

2. The device as defined in claim 1, wherein the resilient means comprises a spring.

3. The device as defined in claim 1, wherein the resilient means comprises an elastic bellows which forms an intermediate piece connecting the additional gas supply line and the opening element.

4. The device as defined in claim 1, further comprising:

a rigid stop mounted to the additional gas supply line, wherein the resilient means comprises a spring, the opening element comprises a ring and the additional gas supply line includes a rigid portion including said rigid stop, which guides said ring against said rigid stop under the influence of said spring.

5. The device as defined in claim 4, wherein the rigid stop is formed as a flange at the rigid portion on the additional gas supply line, and wherein the ring overlaps the flange and includes a corresponding flange which engages the rigid stop flange.

6. The device as defined in claim 4, further comprising:

an elastic heat durable sealing ring, wherein the ring overlaps the rigid portion of the additional gas supply line, and wherein the elastic heat durable sealing ring is arranged in the overlap region of the ring and rigid portion.

7. The device as defined in claim 4, wherein the rigid portion of said additional gas supply line is shaped spherically.

8. The device as defined in claim 7, wherein the rigid stop is formed as a spring ring, wherein the rigid portion has an annular groove formed therein and the ring has a corresponding annular groove formed therein both of which receive a part of said spring ring, and wherein one of said annular grooves is formed as a fitting groove and the other annular groove is formed as a guide groove.

9. The device as defined in claim 1, wherein the additional gas supply line comprises an exhaust gas return line.

10. The device as defined in claim 9, wherein the free end of the opening element is coated with an elastic, heat durable sealing material.

11. The device as defined in claim 9, wherein the area of that portion of the throttle flap valve which serves as the movable valve member is coated with an elastic, heat durable sealing material.

12. In an air induction tube of an internal combustion engine within which a throttle flap valve is pivotably mounted with a portion thereof being pivoted in the direction of air flow through the induction tube, a device for controlling the admission of additional gas quantities into the induction tube, comprising:

an additional gas supply line having a free end;

means mounting the additional gas supply line to the induction tube with part of the additional gas supply line extending into the induction tube and defining therein a valve seat with its free end; and movable valve means for engagement with the valve seat for controlling the flow of additional gas quantities from the additional gas supply line past the valve seat and into the induction tube, said movable valve means comprising: that portion of the throttle flap valve which is pivoted in the direction of air flow; and further means mounted to said throttle flap valve portion for engagement with the valve seat, wherein said further means is both axially and rotationally shiftable relative to the additional gas supply line due to engagement with the valve seat under the influence of the mounting of said further means to said throttle flap valve portion.

13. The device as defined in claim 12, wherein the further means includes: a spherically shaped portion which engages the valve seat; a spring connected to the spherically shaped portion and said throttle flap valve portion for biasing the spherically shaped portion toward the valve seat; and a rigid stop mounted to the throttle flap valve portion which is engaged by an extension of the spherically shaped portion under the influence of said spring.

14. The device as defined in claim 12, wherein the further means includes: a pin and a plate, said plate serving to engage said valve seat, and said pin being mounted to the throttle flap valve portion, both said pin and throttle flap valve portion having complementary spherical surface at their point of contact.

15. The device as defined in claim 14, wherein the further means further includes a snap ring, wherein the throttle flap valve portion includes a ball socket like region, wherein said pin includes a half-spherical head movably mounted within said ball socket like region by said snap ring.

16. The device as defined in claim 14, wherein the further means further includes means for securing the plate against rotation relative to said pin.

17. The device as defined in claim 16 wherein the throttle flap valve portion includes an opening, and wherein said plate includes a pin which engages within said opening to prevent against said relative rotation.

18. The device as defined in claim 14, wherein the further means further includes securing means, wherein the pin is stepped in its axial direction from the plate to the throttle flap valve portion to include a larger and smaller diameter portion with the transition between the two portions having a spherical shape, wherein the throttle flap valve portion includes a bore through which the smaller diameter portion of said pin extends, wherein the diameter of said bore is greater than the diameter of the smaller diameter portion, and wherein said pin is mounted to the throttle flap valve portion by the securing means.

19. The device as defined in claim 18, wherein the complementary spherical surface on the throttle flap valve portion leads into and forms part of said bore, and wherein the securing means comprises a spring disc which axially secures said pin to the throttle flap valve portion.

20. The device as defined in claim 12, wherein the free end of the additional gas supply line is coated with an elastic, heat durable sealing material.

21. The device as defined in claim 12, wherein that area of the further means which engages said valve seat is coated with an elastic, heat durable sealing material.

22. The device as defined in claim 12, wherein the additional gas supply line comprises an exhaust gas return line.

* * * * *